United States Patent [19]

Lewiner et al.

[11] 4,194,189

[45] Mar. 18, 1980

[54] CONTROL DEVICES OF THE RELAY TYPE

[75] Inventors: Jacques Lewiner, Saint-Cloud; Gerard Dreyfus, Villebon sur Yvette; Didier Perino, Suresnes, all of France

[73] Assignee: Agence Nationale de Valorisation de la Recherche (ANVAR), Neuilly-sur-Seine, France

[21] Appl. No.: 891,466

[22] Filed: Mar. 29, 1978

[30] Foreign Application Priority Data

Apr. 5, 1977 [FR] France ..... 77 10323

[51] Int. Cl.[2] ..... G08B 5/00

[52] U.S. Cl. ..... 340/373; 340/378.2

[58] Field of Search ..... 340/373, 378.2

[56] References Cited

U.S. PATENT DOCUMENTS

| | | | |
|---|---|---|---|
| 2,931,954 | 4/1960 | Diesel | 317/144 |
| 3,178,702 | 4/1965 | Aiken | 340/373 |
| 3,210,757 | 10/1965 | Jacob | 340/373 |
| 3,381,291 | 4/1968 | Simshauser | 340/373 |
| 3,528,009 | 9/1970 | Astrove | 324/133 |
| 3,553,364 | 1/1971 | Lee | 178/7.3 |
| 3,648,269 | 3/1972 | Rosenweig | 340/373 |
| 3,648,281 | 3/1972 | Dahms | 340/373 |
| 3,825,927 | 7/1974 | Passien | 340/373 |
| 3,902,170 | 8/1975 | McElroy | 340/373 |
| 3,942,029 | 3/1976 | Kawakami | 307/88 ET |
| 4,065,677 | 12/1977 | Micheron | 307/112 |
| 4,078,183 | 3/1978 | Lewiner | 307/112 |

FOREIGN PATENT DOCUMENTS

| | | |
|---|---|---|
| 1189592 | 3/1965 | Fed. Rep. of Germany . |
| 2400392 | 5/1974 | Fed. Rep. of Germany . |
| 2238277 | 2/1975 | France . |

OTHER PUBLICATIONS

I.B.M. Technical Disclosure Bulletin, "Electrostatic Light Switch", R. W. Callahan.

*Primary Examiner*—Harold I. Pitts
*Attorney, Agent, or Firm*—Brumbaugh, Graves, Donohue & Raymond

[57] ABSTRACT

The invention concerns a switching device using electrets. It comprises at least two electrodes and at least two electrets; control signals are applied between electrodes to cause a mobile element carrying an electret to pass from one rest position to the other.

Application to electrical, pneumatic and optical switching.

11 Claims, 17 Drawing Figures

CONTROL DEVICES OF THE RELAY TYPE

BACKGROUND OF THE INVENTION

In the published French Pat. No. 2,294,535, filed Dec. 10, 1974 and to which correspond U.S. Pat. No. 4,078,183 granted Mar. 7, 1978, there has been described a control device, of the relay type, i.e. able to carry out switching, comprising three mechanical elements one of which is mobile in relation to the two others, characterised by the fact that these three mechanical elements are formed, on the one hand, by two control electrodes between which can be applied a predetermined potential difference and, on the other hand, an electret formed by an insulating piece carrying positive electric charges and/or negative electric charges, the algebraic sum of which is different from zero.

The mobile element could be formed either by the electret or by a control electrode.

Such a device may assume at least two positions, at least one of these positions being stable.

Different embodiments for forming electrical, optical or pneumatic switching devices for monostable or bistable operation have been desdribed in the above-cited French application.

U.S. Pat. Application Ser. No. 863,675, filed Dec. 23, 1977, which corresponds to French Patent Application of Addition No. 76 39795 filed Dec. 31, 1976, discloses a matrix of such control devices.

SUMMARY OF THE INVENTION

The present invention concerns new embodiments in which there is provided in addition to the two control electrodes, at least two electrets, one of which is carried by a first fixed element and the other by a second element which is either fixed or mobile, at least one of these elements being possibly formed by one or both electrodes.

With this arrangement, electrical, optical or pneumatic switching devices of the bistable type are provided which are easy to manufacture, robust, insensitive to mechanical vibrations and to accelerations and enabling a high switching speed to be achieved; furthermore, their electric control means can be simplified.

The invention will be now disclosed in detail with reference to the accompanying drawings.

DESCRIPTION OF THE PREFERRED EMBODIMENTS

Figure 1:
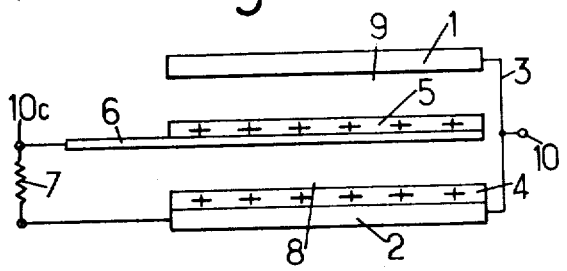
FIGS. 1 to 3 show schematically in section three embodiments of the device according to the invention.

In the embodiment of FIG. 1 the switching device comprises two control electrodes 1 and 2 which are electrically interconnected by a conductor 3; the device comprises two electrets 4 and 5 charged, with the same polarity, e.g. positive, as shown, and each carried by an element; electret 4 is carried by electrode 2 forming a support, whereas electret 5 is carried by an element 6, made from a conducting material (so as to form an electrical screen between the charges of electrets 4 and 5), which is advantageously connected to electrode 2 through a high valve resistor 7 (e.g. of the order of 10 MΩ).

Electrodes 1 and 2 and consequently electret 4 are fixed. On the contrary, element 6 and electret 5 are mobile; they are free to move, without being subjected to a mechanical torque or to a force exerted by a spring, between electrode 1 and electrode 2—electret 4 assembly.

We may assume that electrets 4 and 5 are of the same thickness and are carriers of substantially equal amounts of non balanced electrical charges. When mobile assembly 6-5 is close to fixed assembly 2-4, the forces created by the electric field produced by the charges of electret 4 attract support 6 (which serves as a screen for the charges of electret 5) towards assembly 2-4 and so tends to urge element 6 against electret 4.

On the contrary, if mobile assembly 5-6 is nearer electrode 1 than assembly 2-4, the forces created by the electric field resulting from the positive charges of electret 5 attract assembly 5-6 towards electrode 1 and so tend to apply electret 5 against electrode 1.

These facts being set forth, the operation of the bistable switching device of FIG. 1 is the following.

It is assumed that at the initial instant mobile assembly 5-6 is urged against electret 4, support 6 being at the same potential as electrode 2 (in spite of the high value of resistor 7, in equilibrium the potentials of electrode 2 and element 6 are the same). In this position the electric field reigning in region 8 between support 6 and electret 4 (which are practically in contact) is very much greater than the electric field reigning in part 9 between electret 5 and electrode 1. Mobile assembly 5-6 is in a stable position of equilibrium and so continues to reset on assembly 2-4 in its initial position which constitutes the first stable state of the bistable device.

If then there is applied to input 10 of the device (in relation to terminal 10c) a negative pulse (in relation to the potential of element 6 and so of electrodes 1 and 2), the negative electric charges which appear at electrode 2 create in region 8 an electric field in the reverse direction to that which is created by the electric charges of electret 4. If the negative pulse applied at 10 has a sufficient amplitude to create, in region 8, an electric field which at least cancels out the field created by electret 4, mobile assembly 6-5 is subjected essentially to the electric field existing in zone 9; now this field, because of the presence of positive electric charges in electret 5 and negative charges in electrode 1 which has also received the negative pulse applied at 10, tends to attract mobile assembly 5-6 towards electrode 1. In other words the application of a negative pulse with a sufficient amplitude at input 10 results in a reduction of the electric field between mobile assembly 5-6 and fixed assembly 2-4 (in zone 8) and an increase of the electric field between said mobile assembly and fixed electrode 1 (in zone 9).

The electric forces which, before application of the negative pulse, tended to hold mobile assembly 5-6 against electret 4, are reversed and urge this mobile assembly towards electrode 1 against which this mobile assembly is applied.

At the end of the negative pulse mobile assembly 5-6 continues to remain applied against electrode 1, this position of the mobile assembly forming the second stable state of the bistable device, since in region 9 (more precisely in the narrow gap separating electret 5 from electrode 1 which are practically in contact) there reigns an intense electric field because of the positive charges in electret 5, this field tending to hold electret 5 against electrode 1 for it is much more intense than the field in the reverse direction which exists between fixed assembly 4-2 and mobile assembly 5-6 because of the presence of positive electric charges of electret 4 (the positive charges of electret 5 being insulated from the electric charges of the same polarity of electret 4 by the screen formed by support 6).

To bring mobile assembly 5-6 back from its second stable position (against electrode 1) to its first stable position (initial position against assembly 2-4), it is sufficient to apply to input 10 a positive pulse of sufficient amplitude, for example equal to that of the preceding negative pulse. Such a positive pulse causes positive charges to be injected into electrodes 1 and 2. The presence of positive charges in electrode 1 results in the creation of an electric field which repels electret 5 also positively charged. Furthermore, the presence of positive charges in electrode 2 results in an increase in the intensity of the electric field between fixed assembly 2-4 and mobile assembly 5-6, this increased field tending to attract said mobile assembly towards said fixed assembly. For this reason mobile assembly 5-6 separates from electrode 1, moves towards assembly 2-4 and is applied against electret 4. When the positive pulse is finished, we find again the initial state mentioned at the beginning of the explanation of the operation of the device. Assembly 5-6 will remain in its first stable position until a new negative pulse is applied at 10.

Thus it can be seen that there is provided a bistable switching device which passes from a first state, or position, to a second state, or position, when a negative pulse is applied at 10 and from the second state, or position, to the first state, or position, when a positive pulse is applied at 10.

The purpose of resistor 7 is to allow in equilibrium element 6 to be brought to the same potential as the two electrodes 1 and 2; on the other hand, at the time of applying negative or positive pulses at 10, electrodes 1 and 2 are momentarily brought to respectively negative or positive potential in relation to element 6.

The device of FIG. 1 could also operate without resistor 7 but the inventors have discovered that the presence of resistor 7 could improve the operation.

In a (not shown) modification of the embodiment of FIG. 1, the action of positively charged electret 5 may be re-inforced by that of an electret negatively charged and carried opposite to electret 5, by electrode 1, which forms the support therefor, and the action of positively charged electret 4 by that of an electret negatively charged and carried by element 6 on the face which does not carry electret 5.

The operation of the device according to this modification is the same as that of FIG. 1.

Figure 2:
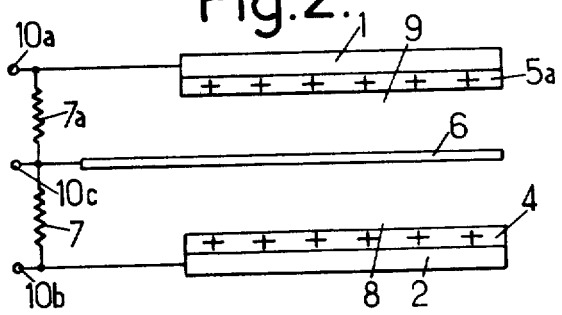

In the embodiment of FIG. 2 there are provided two fixed control electrodes. 1 and 2 each carrying an electret carrying positive charges, i.e. an electret **5*a* carried by 1 and an electret 4 by 2**.

The mobile element is illustrated at 6 and it is formed from a conducting material; this mobile element 6 is connected through resistors **7*a* and 7, of high and equal values (e.g. of the order of 10 MΩ), to electrodes 1 and 2** respectively.

It will be assumed that electrets **5*a* and 4 are of substantially the same thickness and are carriers of substantially equal amounts of positive electric charges. As in the embodiment of FIGS. 1 and 2, mobile element 6** is free to move without being subjected to a mechanical torque or to a force exerted by a spring.

The operation of the device of FIG. 2 is similar to that of FIG. 1. In fact it is to be noted that the two embodiments are essentially distinguished by the following points:

- electret 5 of FIG. 1 disposed on mobile element 6 is replaced by electret **5*a* of FIG. 2 disposed on electrode 1**;
- whereas electrode 1 is connected in FIG. 1 directly to electrode 2, electrode 1 of FIG. 2 is connected through resistor **7*a* to mobile element 6**;
- instead of a single input 10 common to electrodes 1 and 4 (FIG. 1), two inputs **10*a* and 10*b* are provided respectively for electrodes 1 and 2**.

Electret **5*a* of FIG. 2 creates, like electret 5 of FIG. 1, a field tending normally to attract mobile element 6 towards electrode 1**.

In these circumstances, assuming at the outset that mobile element 6 is in its first stable state against fixed assembly 4-2, the field at 8 between elements 6 and 4 tends to hold element 6 against electret 4, as in the case of FIG. 1, the electric field created by electret **5*a* and acting in zone 9** being much smaller.

If a negative pulse of sufficient amplitude is applied to input **10*b* (in relation to 10*c*), this pulse produces the same effect as in the embodiment of FIG. 1 in so far as the field in region 8 is concerned, i.e. to cancel out the field created by the charges of electret 4 in this region. Consequently, mobile element 6 is attracted towards assembly 1-5*a* by the field produced by the charges of electret 5*a*** and is urged against said electret.

When mobile element 6 is against electret **5*a* in its second stable position, it will remain in this position because of the electric field produced in zone 9 by electret 5*a*. In order to cause mobile element 6 to return to its first stable state (against electret 4) it is sufficient to apply to input 10*a* (in relation to 10*c*) a negative pulse of sufficient amplitude for the negative electric charges injected into electrode 1 to create a field cancelling out the field created by electret 5*a*, which cancels out the attraction produced by said electret on mobile element 6 which will then be directed towards electret 4 because of the positive charges on this latter; finally mobile element 6 is urged against electret 4 and remains in its first stable position of equilibrium, even after the discontinuance of the negative pulse applied at 10*a***.

In a modification:

instead of the negative pulse applied to input 10*b*, a potential difference can be applied between input 10*b* and 10*a*, input 10*b* being brought to a negative potential sufficient, in relation to that of input 10*a*, to cause mobile element 6 to pass from its position against electret 4 to its position against electret 5*a*;

instead of the negative pulse applied to input 10*a*, a potential difference can be applied between inputs 10*a* and 10*b*, input 10*a* being brought to a negative potential in relation to input 10*b* to cause mobile element 6 to pass from its position against electret 5*a* to its position against electret 4.

It can therefore be seen that element 6 passes from the first position to the second stable position by applying a negative pulse or voltage at 10*b*, whereas it passes from the second stable position to the first stable position by application of a negative voltage to input 10*a*.

In a (not shown) modification of the embodiment of FIG. 2, one may add on each side of electrode 6 two negatively charged electrets which re-inforce the action of positively charged electrets 4 and 5*a* carried by electrodes 2 and 1.

Figure 3:
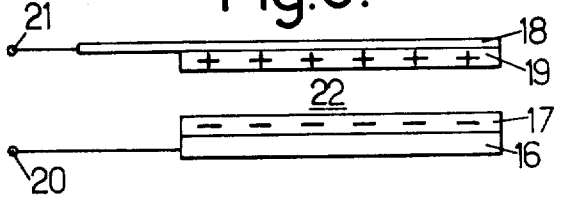

FIG. 3 illustrates a simpler embodiment comprising a fixed electrode 6 carrying an electret 17 carrier of a charge of a first polarity (e.g. negative) and a mobile electrode 18 carrying an electret 19 with charges of the second polarity (e.g. positive). Each electrode comprises an input, i.e. 20 for electrode 16 and 21 for electrode 18.

Figure 6:
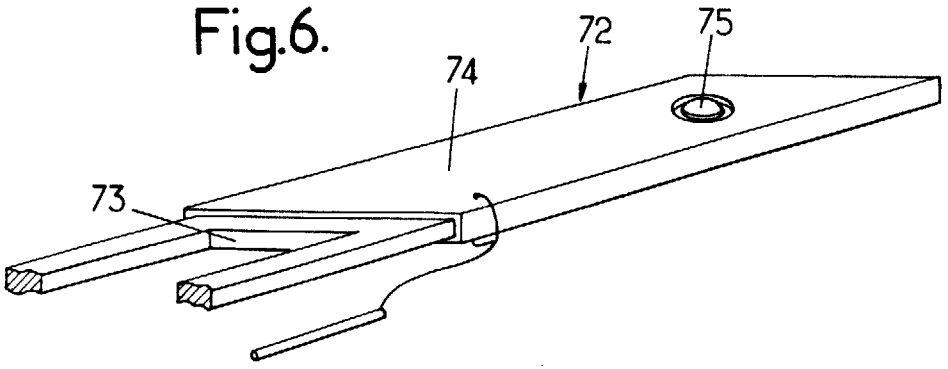
FIG. 6 shows a particular embodiment of the mobile assembly of a device according to the invention.

To explain the operation of the switch of FIG. 3 it will be supposed that at the initial instant mobile electrode 18 is, as illustrated, removed away from fixed electrode 16, electrets 17 and 19 not being in contact. In fact in the embodiment of FIG. 3 resilient means (not shown) normally hold mobile assembly 18-19 away from fixed element 16-17 (as illustrated in FIG. 6): this is the first stable position of this assembly.

If electrode 18 is brought briefly to a positive potential in relation to that of electrode 16, e.g. by applying a pulse of suitable polarity between inputs 20 and 21, the intensity of the electric field reigning in gap 22 between electrets 17 and 19 is increased, which brings mobile assembly 18-19 closer to fixed assembly 16-17 until the former is urged against the latter. In this second stable position, the electric field in residual gap 22 is greatly increased taking into account that the distance between the two assemblies is reduced to the minimum. This is why, when we discontinue putting electrode 18 at a higher potential than electrode 16, i.e. at the end of the pulse, mobile assembly 18 remains urged against fixed assembly 17-16.

To cause mobile element 18-19 to return to the position illustrated in FIG. 1, it is sufficient to apply between the inputs 20 and 21 a voltage of opposite polarity to that previously used, i.e. a pulse of polarity opposed to that applied for causing mobile assembly 18-19 to be urged against fixed element 16-17.

The embodiments illustrated with reference to FIGS. 1 to 3 have been of course given purely by way of illustration.

In the different embodiments of the invention, the electrodes may have different forms and natures depending on the physical variable controlled (electrical, optical, pneumatic). They may be solid, in the form of a grid, porous, in thin layers, obtained by vacuum depositing or by electro-chemical processes, formed by electrically connected conducting areas. In the optical applications they are advantageously transparent (formed from indium oxide or tin oxide) or reflecting. They may be separated by a distance between 1μ and 10 cm.

Each electret may be manufactured from a film or a plate of a polymer, such as polyethylene, polypropylene, polyethylene terephtalate, polytetrafluoroethylene, polycarbonates, halogenated polyhydrocarbides, e.g. a copolymer of hexafluoropropylene and tetrafluoroethylene, a compound based on at least 95% polychlorotrifluororethylene, polyvinylidene fluoride, a compound based on polychlorotrifluoroethylene and polytetrafluoroethylene, a compound based on polyvinylidene fluoride and polytetrafluoroethylene, polyimides or else from the stacking of several layers of such polymers.

The thickness of the electret is between 1000 Å and 200μ; the thicknesses may be obtained directly from the suppliers from 3 to 200μ; below 3μ the electrets may be prepared for example by vacuum depositing (cathode spraying). The electret may also be formed from a mineral material, such as alumina, in which electric charges have been included, e.g. by electronic or ionic implantation or else in which conducting elements have been included and charged.

When the operational temperature of the switch is fairly high, it is particularly advantageous to use a fluorated compound for constructing an electret, stable in time, even at high temperatures.

The surface charge densities of the electrets may be in absolute value between $10^{-11}$ coulomb/cm$^2$ and $10^{-5}$ coulomb/cm$^2$. Instead of using an electret charged with surface charges, it is possible to use an electret which has been volume charged or an electret comprising at one and the same time surface charges and volume charges.

The control voltages or pulses applied to the input terminals may be, depending on the distance between the electrodes forming the system, between 1 volt and 10,000 volts, preferably between 5 and 200 volts.

The devices constructed in accordance with the present invention may be advantageously disposed in hermetic enclosures, either exhausted, or filled with a neutral gas, possibly under pressure.

Several identical devices may be associated, so as to obtain an increased contact force by putting together all the mobile elements, and a reduced space requirement, certain electrodes being common to at least two devices.

The invention may also be used for providing electric switching matrixes, optical or pneumatic, for flat display and visualisation devices.

There will now be described, with reference to FIGS. 4 to 6, embodiments of an electric switching device of the relay type using the invention.

Figure 4:
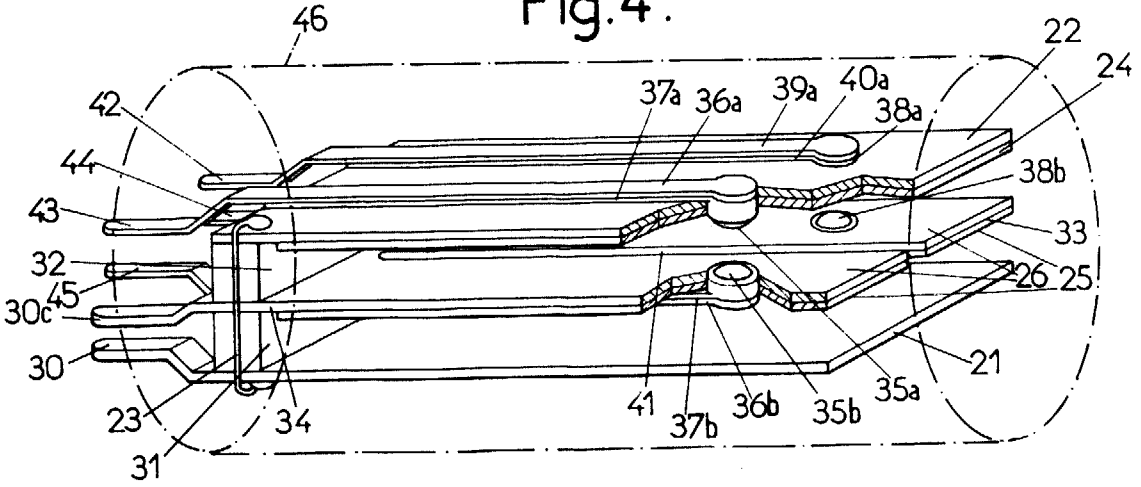
FIGS. 4 to 5 show, in perspective, the application of the invention for providing electric switching, i.e. for forming electric relays.

In FIG. 4, there is illustrated an embodiment which corresponds to the circuit of FIG. 1, but reversed as to top and bottom.

The electric switch of the relay type of FIG. 4 comprises two flat and rigid electrodes 21 and 22 (corresponding respectively to electrodes 1 and 2 of FIG. 1); electrode 22 carries an electret 24 (corresponding to electret 4 of FIG. 1); another electret 25 (corresponding to electret 5 of FIG. 1) is carried by a mobile conducting element 26 (corresponding to element 6 of FIG. 1); a conductor 23 (similar to conductor 3 of FIG. 1) electrically connects electrodes 21 and 22. Finally we find again at 30 and 30*c* the inputs 10 and 10*c* of FIG. 1, input 30 being electrically connected to electrode 21 and so to electrode 22, whereas input 30*c* is connected to mobile element 26. As can be seen in FIG. 4, the mobile element 26 which carries element 25 is nipped between two insulating spacers 31 and 32, so that its free end 33 is able to move in the space between electrodes 21 and 22. To facilitate this movement part 34 of element 26 situated close to spacers 31 and 32 may be made thinner and/or narrower or it can be given any form capable of providing a great flexibility.

Thus for example the narrowing down can be achieved in the zone which is to play the role of hinge, this narrowing down being effected by electro-erosion or by cold or hot forging.

The connection between the mobile electrode an the rest of the device may also be provided by means of a flexible polymer film, fixed to this element, this film being metallized so that the control voltages may reach the mobile electrode. This film could be formed by the electret itself.

These measures have for purpose to form a conducting blade which is at one and the same time rigid in its portion subjected to electrostatic forces, so as to provide a good electrical contact, and flexible in its portion connecting it to the rest of the device so as not to hinder its movement.

The system which has just been described and whose operation is the same as that which has been described above with reference to FIG. 1, comprises a first pair of cooperating contacts (i.e. contacts 35*a* and 35*b* carried by conductors 36*a* and 37*b* respectively, an insulating layer 37*a* separating conductor 36*a* from the corresponding conducting part of electrode 22 and an insulating layer 37*b* separating conductor 36*b* from electrode 25.

It may also comprise a second pair of cooperating contacts 38*a* and 38*b* carried in the same way (in FIG. 4 can be seen conductor 39*a* which carries contact 38*a* and the insulating layer 40*a*). A slit 41 may divide mobile assembly 26-25 into two parts so that each pair of contacts operates in the best conditions, i.e. that the contact studs themselves are well and truly against each other when mobile assembly 25-26 is placed against fixed assembly 22-24.

It is to be noted that the contact studs may be non-rigidly mounted, e.g. on small spring blades. Thus, and taking into account the geometry of the system and of the mode of movement of the mobile electrode, the studs may slide slightly against each other when brought into contact, which ensures self-cleaning of these contact studs.

Moreover, these springs are compressed under the effect of the electro-static force; when the switching control voltage is applied, in accordance with what has been described above with reference to FIG. 1, the electro-static force is cancelled out and the springs throw the mobile element back towards the other electrode, reducing the switching time of the device and increasing its current and voltage breaking power.

The studs may be formed for example by silver capsules covered with gold.

Pins 42, 43, 44 and 45 correspond to contacts 38*a*, 35*a*, 38*b* and 35*b* respectively.

It should be noted that the conductors with their studs may be disposed otherwise than as illustrated in FIG. 4.

In the previously quoted examples, the controlled contacts have always been shown connected directly to the fixed or mobile elements of the devices.

Of course, the mobile element may control these contacts through force or movement reduction systems, numerous examples of which are known in the prior art.

Moreover, electrodes 21 and 22 which are substantially parallel may be sloping in relation to each other and have different shapes so that when they come into contact the shape of the mobile assembly may mate better with the shape of the fixed electrode 21 or 22 against which it comes into contact.

Thus the part of the mobile electrode forming a hinge may be flexible and the electrodes may form an angle therebetween so the distance between the fixed electrode and the mobile electrode is constantly small; consequently the effective force for the electrical contact is greater than that obtained in the case when, the fixed electrodes being parallel to each other, a whole part of the mobile electrode is away from the fixed electrodes.

Finally the unit formed by the electrodes, the electrets, mobile assembly 25-26 and the contacts and conductors may be disposed inside an hermetic enclosure 46.

In a (not shown) modification, the contacts may be located outside the hermetic enclosure, so that the electret is not subjected to the influence of the ions formed by a possible electric arc at the contacts. In this case, the hermetic enclosure must have flexible or deformable parts allowing the contacts to be controlled by the mobile element.

In the embodiment of example 1, the rocking of the mobile assembly 25-26 from a stable position to the other (against electrode 21 or against electrode 22) is achieved by means of positive or negative voltage pulses applied to terminal 30 relatively to terminal 30*c*. In FIG. 6 there is shown the mobile element during switching between the two stable positions.

Figure 5:
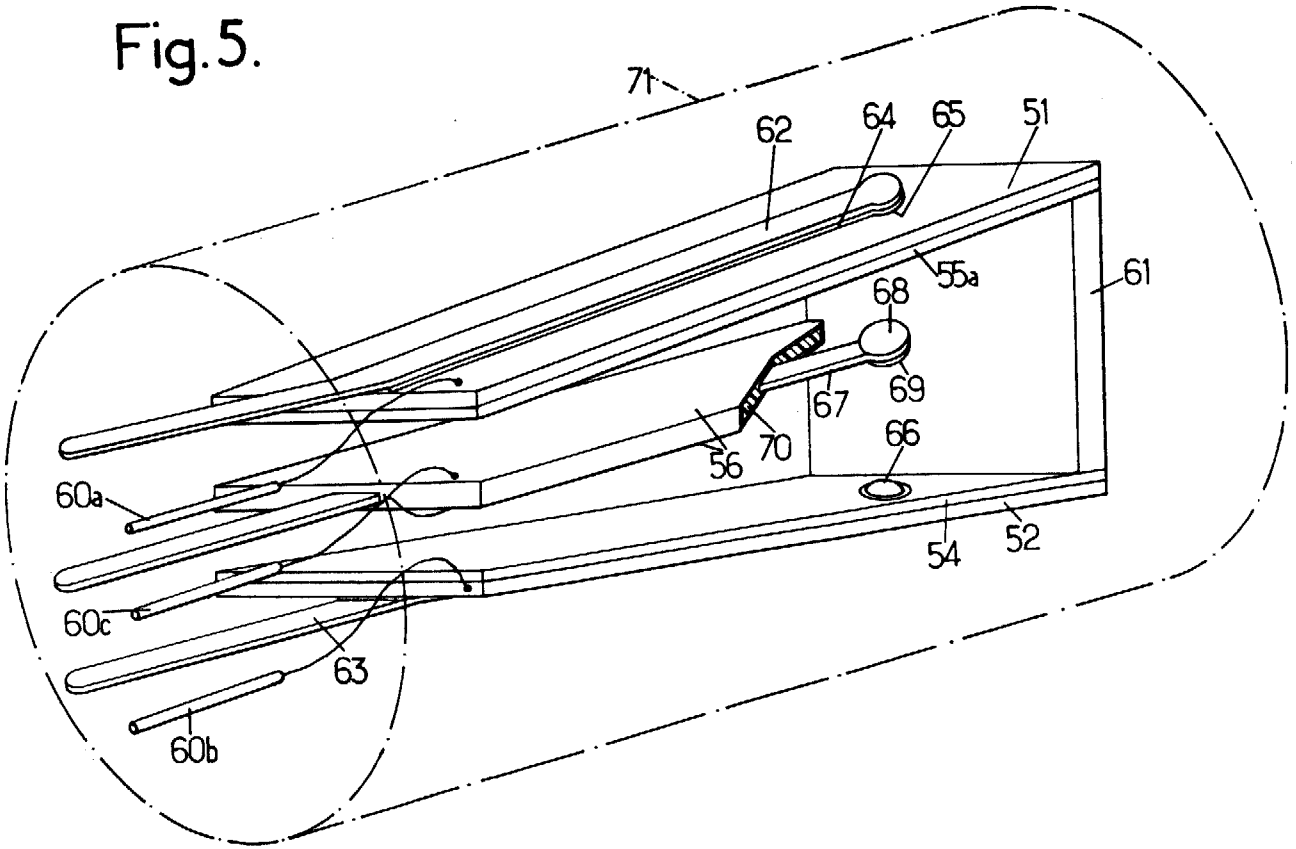

FIG. 5 shows a third embodiment of an electric relay, this embodiment using the schematic arrangement according to FIG. 2. The relay of FIG. 5 comprises two fixed electrodes 51 and 52 carrying respectively electrets 55*a* and 54 having the same polarity, the same thickness and the same charge. Electrodes 51 and 52 are maintained in place by an insulating spacer 61 and carrying conducting blades 62 and 63 insulated therefrom by insulating strips one of which can be seen at 64; contacts 65 and 66 are carried by blades 62 and 63 respectively.

A third conducting blade 67 carrying contacts 68 and 69, facing respectively contacts 65 and 66, is coated with a layer 70 of an insulating material carrying on its two faces a metal deposit 56. Output terminals 60*a*, 60*b* and 60*c* are connected respectively to electrode 51, to electrode 52 and to the conducting layers 56.

The assembly is contained in a sealed enclosure 71. The electrets 51, 52 and blade 67 are carried by the wall of enclosure 71.

We find again then the arrangement of FIG. 2, electrodes 51 and 52 playing the role of electrodes 1 and 2 thereof, electrets 55*a* and 54 the role of electrets 5*a* and 4 of FIG. 2, metallized layers 56 the role of mobile element 6 of FIG. 2 and terminals 60*a*, 60*b* and 60*c* the role of terminals 10*a*, 10*b* and 10*c* of FIG. 2.

Depending on whether the mobile element formed by metallized layers 56 is urged against electrode 51 or electrode 52, the electrical circuit is established between contacts 65 and 68 or else between contacts 69 and 66.

To cause mobile assembly 67, 70, 56 to pass from one stable position to the other, it is sufficient to apply, for the reasons given with reference to FIG. 2, simultaneously a potential difference between terminals 60c and 60b and a potential difference equal in absolute value and of the opposite polarity between terminals 60a and 60c.

In a modification, illustrated in FIG. 6, mobile element 72 is formed by a conducting blade 73 made from spring steel or bronze, a few hundredths of a millimeter thick and coated with a very thin layer of an insulating varnish, itself coated with a metal deposit 74 forming the mobile electrode. In the zone where the electric contact is to be effected, the metal deposit and the varnish have been removed by a photochemical process (or the varnishing and the depositing have been prevented by a mask) and a capsule 75 made of gold or any other metal or alloy appropriate to the formation of a good electrical contact has been disposed.

In a modification, blade 73 is made from aluminium coated by anodization with an insulating layer of aluminium oxide replacing the varnish, this layer forming possibly the electret.

Preferably, the left-hand end of blade 73 is flexible owing to the use of the previously mentioned means.

Figure 7:
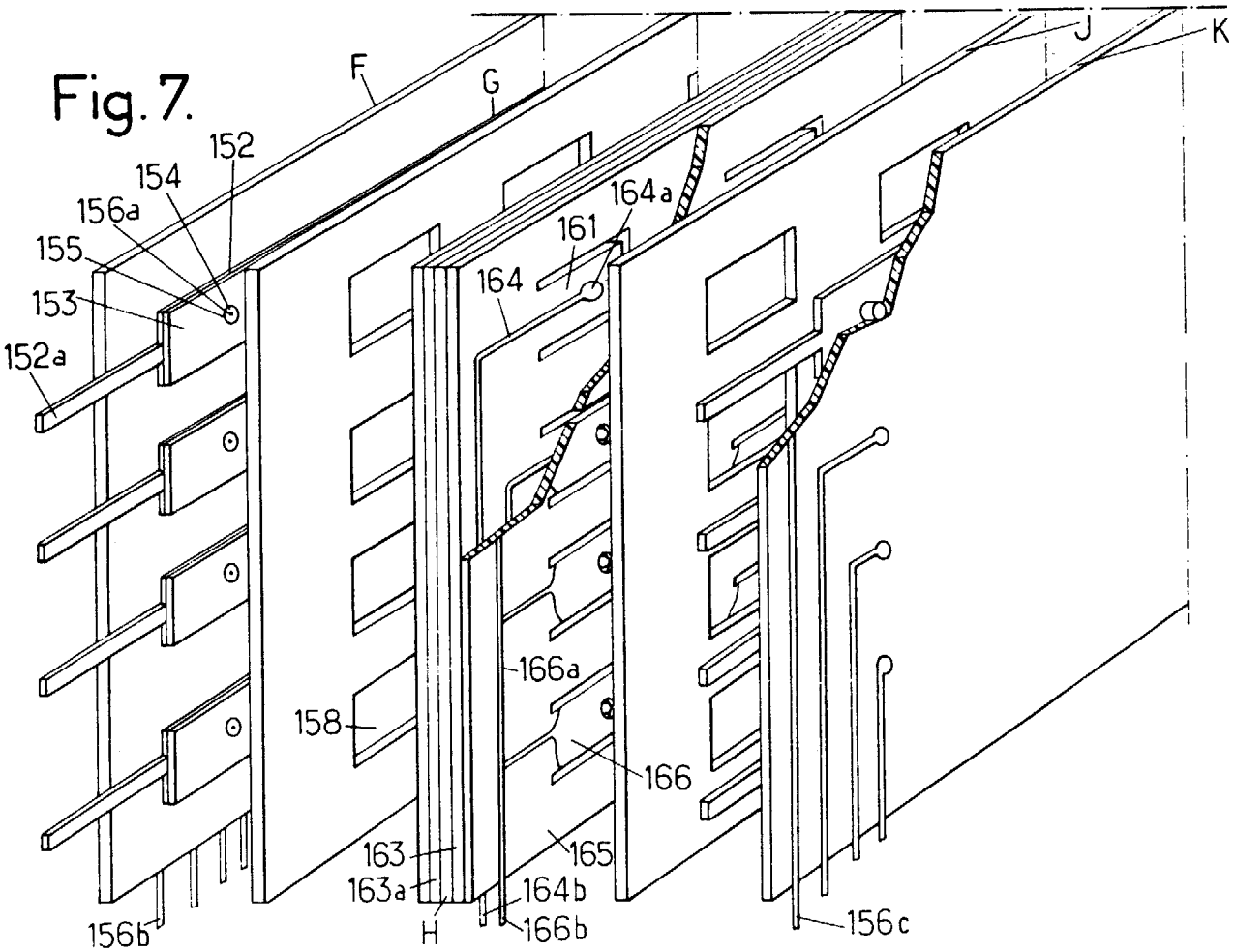
FIG. 7 shows in perspective an electric switching matrix comprising the improvements of the invention.

In FIG. 7 there is shown, exploded and partially cut away, an electric switching matrix formed by a multiplicity of elementary switches using the improvements of the invention. The matrix comprises several flat plates F, G, H, J, K.

Plate F is made from an insulating material, of the type used for constructing printed circuits. The internal face of this plate F carries rectilinear electrodes 152, eleongated and all parallel in the same direction. For example, these electrodes are parallel to the upper edge of plate F and comprise one end 152a having reduced width, intended for connecting said electrodes to the excitation circuit of the matrix. These electrodes may be formed by metallization. They are each coated with an electret 153, of the same shape as they.

Each electrode 152 is provided, at even spacings, with holes 154 through which passes an insulating sleeve 155 enclosing a conductor terminating in a contact stud 156a. Each contact 156a is connected, through a conducting circuit printed on the outer face of plate 51, to a terminal 156b for connecting contact 156a to the rest of the controlled electrical circuit.

The second plate G is also formed from an insulating material. It comprises, cut out at even intervals, rectangular windows 158 disposed in lines and columns parallel to each other, so that each line of windows is situated opposite an electrode 152.

The third plate H may be made from a conducting or an insulating material. It comprises a number of slits cut out so as to form tongues or blades 161, rectangular in shape, one end of which is attached to plate H and the other is free to move. Each blade 161 has dimensions slightly less than the dimensions of windows 158. Blades 161 are disposed in parallel lines, each blade 161 being located opposite a window 158.

Plate H is coated on both faces with an insulating layer 163, 163a on which are printed conducting paths 164, each conducting path finishing at a contact stud 164a, situated on blades 161, on each side and just opposite fixed contacts 156a. The other end of conducting path 163 is connected to a terminal 164b for connecting the contact 164 to the rest of the controlled circuit.

When the free ends of blades 161 are urged against electrets 153, contacts 156a and 164a touch and the controlled circuit is closed.

On insulating layer 163 is deposited another insulating layer 165 on which are deposited by metallization electrodes 166 for the control of the system, except at the place where contact 164a is to be found, which is not coated either with the insulating layer 165. The control electrodes situated in the same column are connected together by a printed conducting path 166a, connected to a terminal 166b, which is intended to connect the set of electrodes 166 to the excitation circuit of the matrix.

The fourth plate J is in all points identical to plate G, whereas the fifth plate K is identical to plate F.

It is clear that when a voltage pulse is applied between a terminal 156b of plate F and a terminal 164b, and simultaneously a voltage pulse equal in absolute value, but of the opposite polarity, between the same terminal 164b and the corresponding terminal 156c of plate J, the mobile blade situated at the intersection of electrode column 164 and fixed electrode line 152 will be urged against one of the two plates 151 or 168, thus closing a contact.

In the device of FIG. 7, all the controlled contacts are independent of each other.

In fact, in the case where a matrix of crossing points used in telephonic switching is constructed, all the contacts 154a in the same column of blades may be interconnected as also all the contacts 156 relative to the same electrode 152.

A not shown modification of this device could be formed by associating, similarly to what has just been described, several switches operating as described with reference to FIG. 1, i.e. with a fixed electret and a mobile electret.

All the constructional details already mentioned in connection with the simple switches described with reference to FIG. 1 to 6, particularly in so far as the shape of the fixed electrodes, their slope, the nature of the electrets, and the different processes used for making the hingeing of the blade flexible are concerned, are also valid for the construction of the matrices.

Such a matrix may be used as a crossing point matrix for switching telephone circuits or else as a static memory, since each of its elements is bistable.

There will now be described with reference to FIGS. 8 and 9 two applications of the invention to pneumatic control devices.

Figure 8:
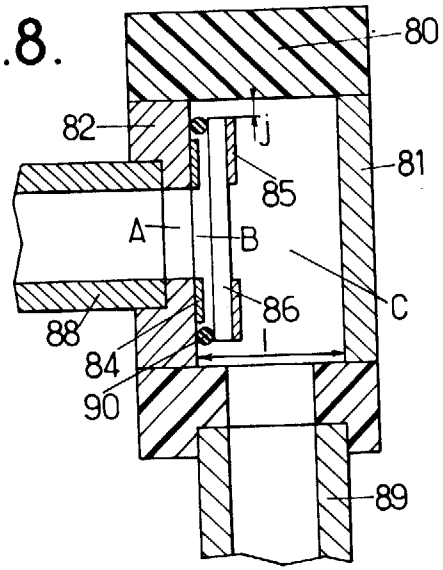

In FIG. 8 there is shown a device which allows, when it is desired, a circuit for a fluid to be interrupted. The control device is of the type illustrated in FIG. 1. It comprises, disposed in an insulating case 80, two fixed electrodes 81 and 82 (corresponding to electrodes 1 and 2 of FIG. 1), electrode 82 carrying an electret 84 (similar to electret 4 of FIG. 1). Electrode 82 like electret 84 comprises a central circular aperture A, B respectively for the passage of the fluid, a pipe 88 being fixed in electrode 82. The mobile assembly is formed by a full rigid element 86 and an electret 85; elements 85 and 86 correspond to elements 5 and 6 of FIG. 1. A second pipe 89 is fixed in case 80 and it communicates with chamber C in which mobile assembly 85-86 may move. It is to be understood that the schematic FIG. 8 is not to scale and that length l of chamber C and clearance j are much smaller relatively than shown in this FIG. 8.

Finally an O-seal 90 is disposed against the wall of electrode 82 which defines chamber C.

In FIG. 8 there has not been shown the electric control devices for moving mobile assembly 85-86 between one of its stable positions illustrated in FIG. 8 and the other stable position against electrode 81, the electric control being achieved as explained with reference to FIG. 1.

It will be readily understood that in the position shown assembly 85-86 stops up the passage between pipe 88 and chamber C, whereas in the opposite stable position, against electrode 81, is allows free passage between pipe 88 and pipe 89. Thus is formed a pneumatic switch.

Figure 9:
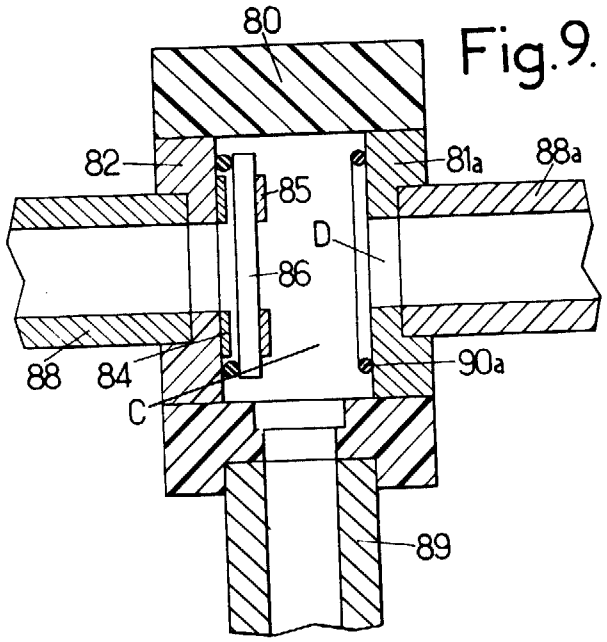
FIGS. 8 and 9 show in section two pneumatic switching devices incorporating the improvements of the invention.

The embodiment of FIG. 9 is similar to that of FIG. 8, apart from the fact that electrode 81 of FIG. 8 is replaced by an electrode 81*a*, which is provided with a central aperture D and in which is fitted a pipe 88*a*, and that an O-seal 90*a* is provided against electrode 81*a*. Mobile assembly 86-85 may assume either the position shown in the Fig., in which pipe 89 communicates with pipe 88*a* through chamber C, or the other stable position in which it comes against O-seal 90*a* and in this case pipe 89 communicates with pipe 88 through chamber C. The device of FIG. 9 thus provides switching between pipe 89, on the one hand, and either pipe 88 or pipe 88*a* on the other.

In FIGS. 10 to 17 there have been illustrated embodiments of optical switches.

Figure 10:
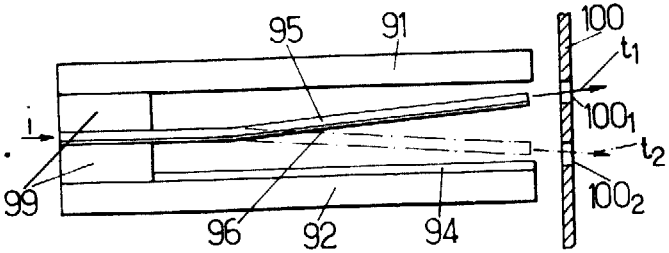
FIG. 10 shows in section an embodiment of an optical switching device incorporating the improvements of the invention.

In FIG. 10 there is shown a first embodiment for causing deflection of an incident optical beam i. The device, which uses the arrangement of FIG. 1, comprises two fixed electrodes 91 and 92 (corresponding to electrodes 1 and 2 of FIG. 1) and two electrets 94 (carried by 92) and 95 carrying a vacuum deposited metal layer 96 (which plays the role of element 6 in FIG. 1, whereas electret 95 plays the role of element 5 of this FIG. 1). Electret 95 is made from a material transparent to the radiations of beam i or carries a light guide for this radiation. Two insulating spacers 99 hold in position, at the left-hand end, mobile assembly 95-96 which has been shown in its two stable positions, one by a continuous line and the other by a dot-dash line. An opaque plate 100 is disposed at the right-hand part and it is provided with two holes $100_1$ and $100_2$. In its first position, that shown by a continuous line, the incident ray i is deflected upwards by transparent electret 95 and forms the transmitted ray $t_1$ passing through hole $100_1$, whereas when electret 95 is in its position shown by a dot-dash line the transmitted ray is shown at $t_2$ and passes through hole $100_2$.

Figure 11:
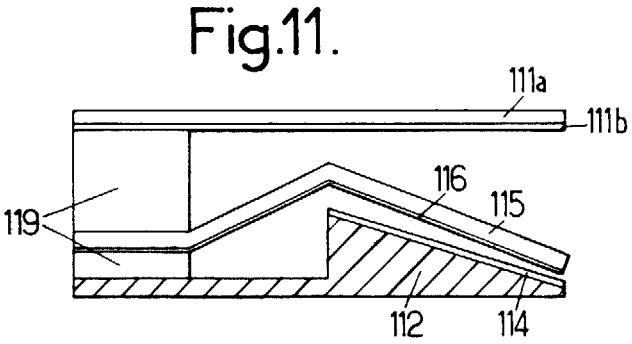
FIGS. 11 and 12 show in section and in two different positions, an optical switching device according to the invention.
Figure 12:
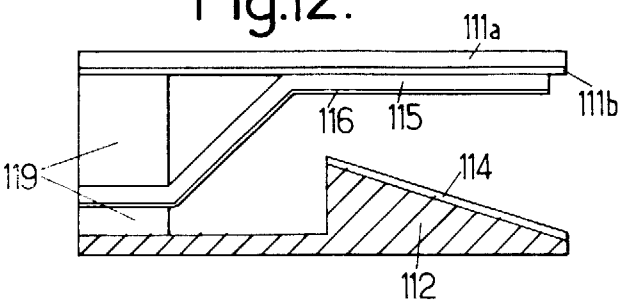

In the embodiment of FIGS. 11 and 12 the arrangement of which is of the type illustrated in FIG. 1, there is provided a first electrode formed by a glass plate 111*a* coated on its lower face with a transparent conducting deposit 111*b*, the assembly 111*a*-111*b* forming the equivalent of electrode 1 of FIG. 1.

The second fixed electrode is formed by a metal block 112 having the shape shown and the active part of which carries an electret 114, elements 112 and 114 corresponding respectively to elements 2 and 4 of FIG. 1.

The mobile element is formed by an electret 115 made from a transparent material and carrying a reflecting metal deposit 116, elements 115 and 116 of FIGS. 11 and 12 corresponding respectively to elements 5 and 6 of FIG. 1. This mobile element is held in place by spacers 119 between fixed elements 112 and 111*a*-111*b*.

The mobile assembly rocks between the two stable positions shown in FIGS. 11 and 12, i.e. a first position (FIG. 11) in which the mobile assembly is against the lower fixed assembly 112-114 and a second position (FIG. 12) in which said mobile assembly is against the upper fixed assembly 111*a*-111*b*.

In both positions, the reflection conditions of the light coming from above on to electret 111*b* are different, which allows a contrasted zone to be created solely when the mobile assembly is in the position of FIG. 12, or a light beam to be deflected.

Figure 14:
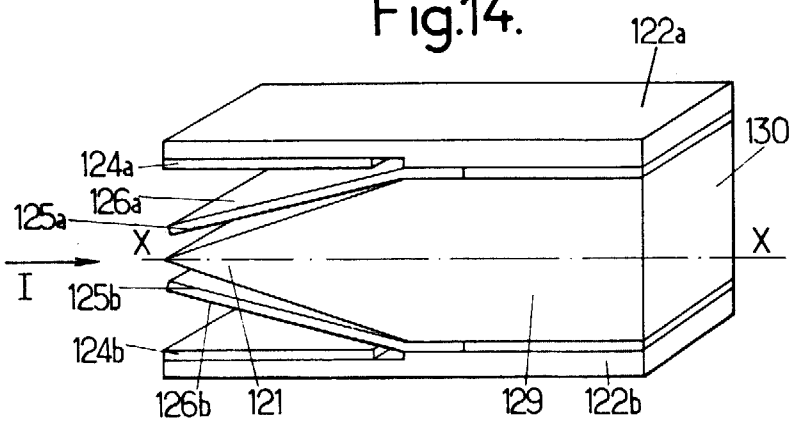
FIGS. 13 and 14 show two other embodiments of an optical switching device incorporating the improvements of the invention.
Figure 13:
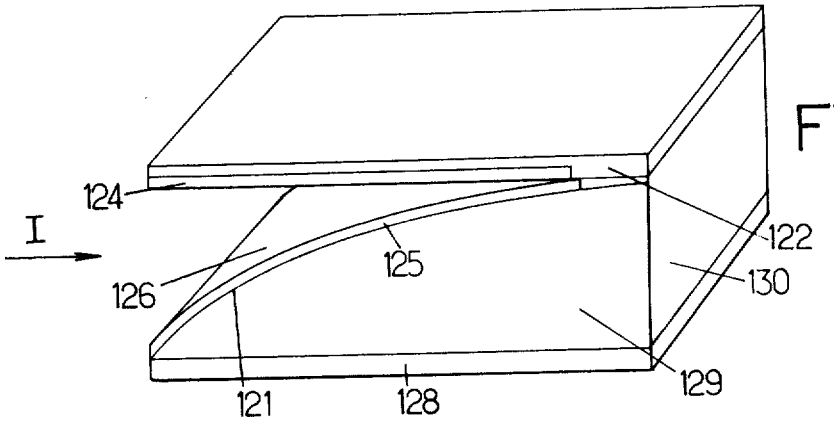

FIGS. 13 and 14 show two devices for letting a light ray pass or not, particularly for constructing an alphanumerical display.

The device of FIG. 13, which is of the type illustrated in FIG. 1, but with inversion of top and bottom, comprises two fixed electrodes 121 and 122 (corresponding respectively to electrodes 1 and 2 of FIG. 1), electrode 122 carrying an electret 124 (which corresponds to electret 4 of FIG. 1) and electrode 121 of a curved shape being formed by a transparent metallization layer disposed on a block 129 of a transparent material such as glass or an organic glass (of the "Plexiglass" type), provided on opaque plate 128. The mobile assembly is formed by a flexible electret 125 fixed on an opaque element 126 which may be formed by metallization of electret 125 (elements 125 and 126 corresponding respectively to elements 5 and 6 of FIG. 1). The two electrets 124 and 125 carry charges of the same polarity. In FIG. 13 there has not been illustrated the electrical control means which are the same as those illustrated in FIG. 1.

When mobile assembly 125-126 is applied against lower electrode 121, the incident light beam I cannot penetrate into block 129 because of the nature of the opaque layer 126; on the contrary, when mobile assembly 125-126 is in its upper stable position against electret 124, the light beam I can penetrate into transparent block 129 and illuminate the frosted face 130 thereof to provide a display.

The curved shape given to electrode 121 allows better switching because, on the one hand, of the ease of winding or of unwinding of the mobile part and, on the other hand, because of the increased attraction of the mobile element at its right-hand end. Of course, this shape is not limiting.

The mode illustrated in FIG. 14 is of the same type as that illustrated in FIG. 13 with the difference that electrode 121 is shown flat.

Figure 15:
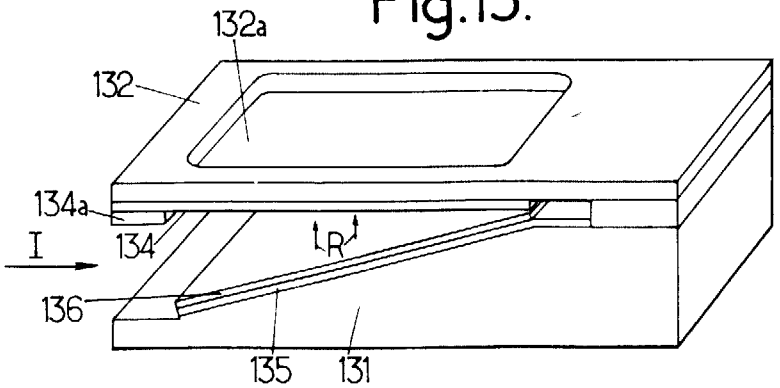
FIG. 15 illustrates a display device incorporating the improvements of the invention.

In fact it is formed by the part of the device of FIG. 15 which is above the base plate 128 and by the mirror image of this part, the plane of symmetry of the embodiment of FIG. 14 being shown symbolically by XX.

In the embodiment of FIG. 14 we have then two fixed electrodes 122*a* and 122*b* (corresponding to the fixed electrode 122 of FIG. 18), two electrets 124*a* and 124*b* (corresponding to electret 124 of FIG. 18), two mobile assemblies 125*a*-126*a* and 125*b*-126*b* (corresponding to mobile assembly 125-126 of FIG. 15).

When the mobile assemblies 125*a*-126*a* and 125*b*-126*b* are against electrode 121, the incident beam I cannot penetrate into the mass of glass 129; on the contrary when these mob'le assemblies are urged against electrets 124*a* and 124*b* respectively, the beam I passes through the transparent block 129 lighting up the frosted face 130 thereof. The arrangement of FIG. 14 allows the width of frosted face 130 to be doubled in relation to the embodiment of FIG. 13.

FIG. 15 shows a modification of the device of FIG. 13. It comprises two fixed electrodes 131 and 132 of which electrode 132 comprises a transparent conducting window 132*a* and carries an electret 134 made from a transparent material. The mobile assembly is formed by a reflecting element 136 on which is fixed an electret 135 which is on the electrode 131 side.

When mobile assembly 135-136 assumes the position shown in FIG. 15, the incident light beam I is reflected by 136 and the radiation R which results therefrom illuminates window 132*a* which is frosted and may form an alphanumeric display segment. On the contrary when mobile assembly 135-136 is in its upper position against electret 134, window 132*a* is not lit up.

The diffusing material forming element 136 may be replaced by a fluorescent substance sensitive to ultraviolet rays 40. Then window 132*a* is only illuminated when assembly 135-136 intercepts a light beam I of the appropriate wave-length. If window 132*a* is opaque to ultraviolet rays, the daylight cannot activate the fluorescent substance of mobile element 136 when the mobile element is urged against electrode 132 and window 132*a* remains then dark.

A flange 134*a* may be provided made from a material opaque to radiation I for leaving element 136 dark when mobile assembly 135-136 is urged against electret 134.

The embodiment of FIG. 15 could also be modified like that of FIG. 13 by bending elements 135, 136 and the sloping upper face of electrode 131.

Face 130 of FIGS. 13 and 14 could carry a coloured optical filter for providing a coloured display.

Figure 16:
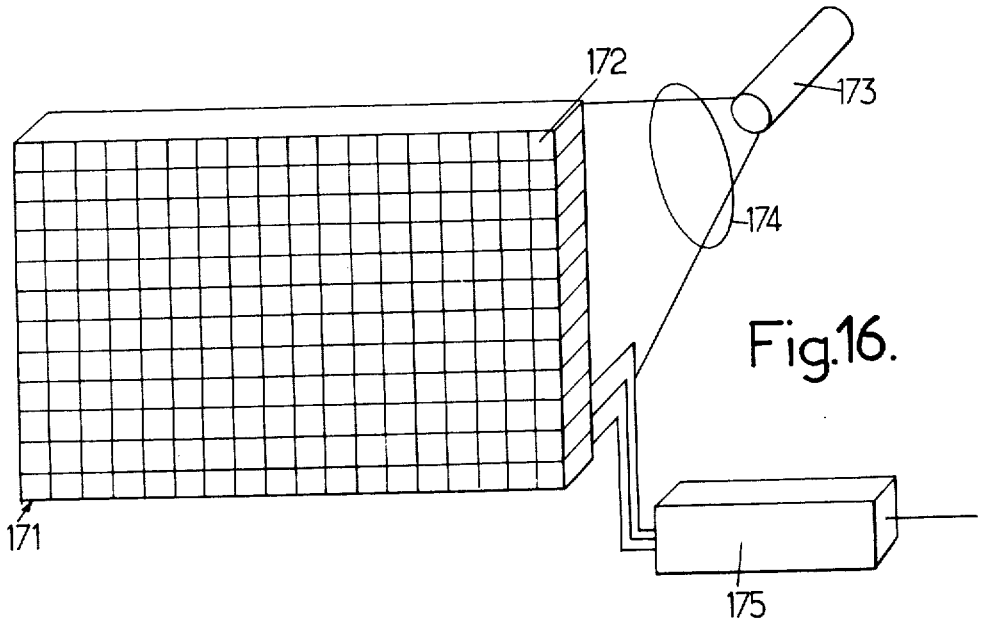
FIG. 16 shows the application of the invention to a television system.
Figure 17:
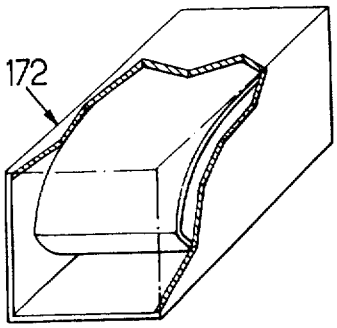
FIG. 17 finally shows a detail of FIG. 16.

In FIG. 16, as well as in FIG. 17 which illustrates to a larger scale a detail of FIG. 16, there is schematically shown a television system on a large size flat screen.

Screen 171 is formed by a number of display elements 172 (of the type described with reference to FIGS. 13 to 15). The number of elements 172 to be assembled depends on the definition as well as on the ratio between the height and the width of the image desired.

Each of these elements is lit from behind for example by means of the light source 173 which emits a collimated beam by means of the optical system shown schematically at 174.

In the case where there is used as display element a system such as that described in FIG. 15, the light must be brought to each element by optical guides or mirrors.

A scanning unit 175 sends out the control pulses and modulates the light intensity of the beam produced by source 173, for each element 172 shown to a larger scale in FIG. 17 and which is of the type illustrated in FIG. 14 for example.

It is to be noted that for a conventional system of 625 lines, a large number of elements must be addressed in a time compatible with the timing of the image which is about 25 or 30 images/sec. That implies very short addressing times, of the order of 0.1 $\mu$s, but which are compatible with the system since each element is in fact a capacitor of low capacity which may be charged in a very short interval of time. Then the mobile assembly of each display element must switch in a time less than 1/30th of a second, which is indeed the case for the system described here for the switching time may be of the order to 1 ms.

Finally this system presents, over all the electrostatic display systems known up to date, the advantage of being bistable and of requiring no current supply for remaining in a given state.

During the display of very short events, an image thereof can thus be maintained indefinitely, such a system may then be used as a memory.

The scanning system may be controlled for example by a video receiver, a recorder, a computer.

The devices which have just been described with reference to the figures and which are constructed by using the improvements of the invention present the advantage of forming bistable devices capable of providing switching and which, in most cases, operate without requiring a mechanical return torque associated with the mobile element, which facilitates switching and simplifies the general design. In particular the connection between the mobile assembly and the rest of the device may be very flexible; it may be formed by the electret itself.

The manufacture of these devices is simplified by the fact that in general no mechanical part comprises more than one electret.

They may be constructed in configurations of small thickness and large lateral dimension.

Control devices can also be constructed according to the invention having three stable positions instead of two, e.g. in the following way: in the schematical embodiments of FIGS. 1 and 2, resilient means are provided for maintaining the central mobile assembly (e.g. 56 in the case of FIG. 1) in the central position illustrated in the figure in the absence of any application of control voltage.

As is evident and as it follows moreover from what has gone before, the invention is in no wise limited to those of its modes of application and embodiments which have been more specially discussed; it embraces, on the contrary, all variations thereof.

All the devices described by way of examples may be surrounded by an electrostatic screening formed by a grid or even by a component part of the fixed electrodes, this screening having as its purpose to insulate the devices from outside electromagnetic or electrostatic disturbances.

Particularly in the case where several devices are associated for forming a matrix, none of them may be influenced by neighbouring devices.

Likewise this screening allows the electret to be protected when the environment in which the device is to operate is rich in electrical charges.

The switching of the matrixes of elementary devices according to the invention may be achieved by lines and columns, by means of line pulses, on the one hand, and column pulses, on the other hand, the single device which occupies said line and said column being alone switched because each of these pulses has an amplitude between the amplitude necessary for switching and half of this amplitude.

We claim:

1. In a control device having at least two elements including two control electrodes, one of said elements comprising a mobile element, moving in response to electric signals between first and second positions, and means for supplying electric control signals to said electrodes, the improvement wherein there are provided at least two electrets, one of said electrets carried by one of said fixed elements and another of said electrets carried by another of said elements, either fixed or mobile.

2. A device according to claim 1, wherein said elements include two flattened fixed electrodes and, between these two electrodes, at a distance therefrom, a third mobile flattened electrode, a first electret being carried by one of the fixed electrodes on its surface facing the mobile electrode and the second electret being carried by the mobile electrode on its surface facing the other fixed electrode.

3. A device according to claim 1, wherein said elements include two fixed flattened electrodes and, between these two electrodes at a distance therefrom, a third mobile flattened electrode, electrets of the same polarity being carried by the surfaces of the two fixed electrodes facing the mobile electrode.

4. A device according to claim 2 or 3, wherein there are provided electric contact studs carried by the mobile electrode and at least one of the fixed electrodes, said studs being connected to outside electrical circuits by conducting blades insulated from the electrodes which carry them and possibly from the electrets carried by these electrodes.

5. A device according to claim 4, wherein at least some of said electrical contact studs are carried by spring mounted elements.

6. A device according to claim 1, 2 or 3, for controlling fluid flow and having an enclosure for said fluid and at least two pipes which communicate with the inside of the enclosure through apertures provided therein, the mobile element being able to stop up at least one of said apertures in a first position for closing off the communication between the inside of the enclosure and the pipe which corresponds to this aperture.

7. A device according to claim 1, 2 or 3, wherein said mobile element is for deflecting a light ray, said deflection being different for said first and second positions.

8. A device according to claim 1 wherein each electret comprises a fluorated polymer.

9. An assembly of a plurality of control devices according to any one of claims 1, 2 or 3 and forming an electrical switching matrix.

10. A device according to claim 9, wherein said mobile elements are formed by parts cut out from a plate while remaining attached thereto.

11. An assembly of a plurality of control devices according to claim 7 and constituting an optical display system.

* * * * *